United States Patent [19]

Danese et al.

[11] 4,264,652

[45] Apr. 28, 1981

[54] METHOD FOR LOCALLY GALVANIZING A PIECE OF METAL

[76] Inventors: Désiré Danese, rue des Rondes-Haies, 87, B-4120 Ivoz-Ramet; Eugène Pantusa, rue Champs d'Oiseaux, 127, B-4111 Flemalle-Grande, both of Belgium

[21] Appl. No.: 74,723

[22] Filed: Sep. 12, 1979

[30] Foreign Application Priority Data

Sep. 13, 1978 [BE] Belgium ..... 46604

[51] Int. Cl.[3] ..... C23C 1/02

[52] U.S. Cl. ..... 427/282; 427/329; 427/438; 427/300

[58] Field of Search ..... 427/282, 300, 156; 106/90, 91, 92, 93; 148/13.1, 14

[56] References Cited

U.S. PATENT DOCUMENTS

| | | | |
|---|---|---|---|
| 2,894,850 | 7/1959 | Greene et al. | 427/300 |
| 3,089,780 | 5/1963 | Siple | 427/300 |
| 3,121,019 | 2/1964 | Blay | 427/300 |
| 3,149,987 | 9/1964 | Crandall | 427/300 |
| 3,181,963 | 5/1965 | Cook et al. | 427/300 |
| 3,398,010 | 8/1968 | Harvey et al. | 427/300 |
| 3,751,275 | 8/1973 | Oken | 106/90 |
| 4,125,647 | 11/1978 | Goto | 427/300 |
| 4,177,303 | 12/1979 | Clipson | 427/300 |

*Primary Examiner*—Ralph S. Kendall

*Attorney, Agent, or Firm*—Fishman and Van Kirk

[57] ABSTRACT

Method for locally galvanizing a ferrous metal article, preferably a strip or a sheet.

The article is coated on the surface to be protected from the galvanization by an aqueous suspension of cement and is thereafter dried, heated to a temperature above the melting point of the zinc and moved through a bath of molten zinc. It undergoes finally a cleaning step to remove the masking cement material and possibly a final rinsing.

Articles thus obtained may be one side galvanized steel strips to be used in the automobile industry.

9 Claims, 1 Drawing Figure

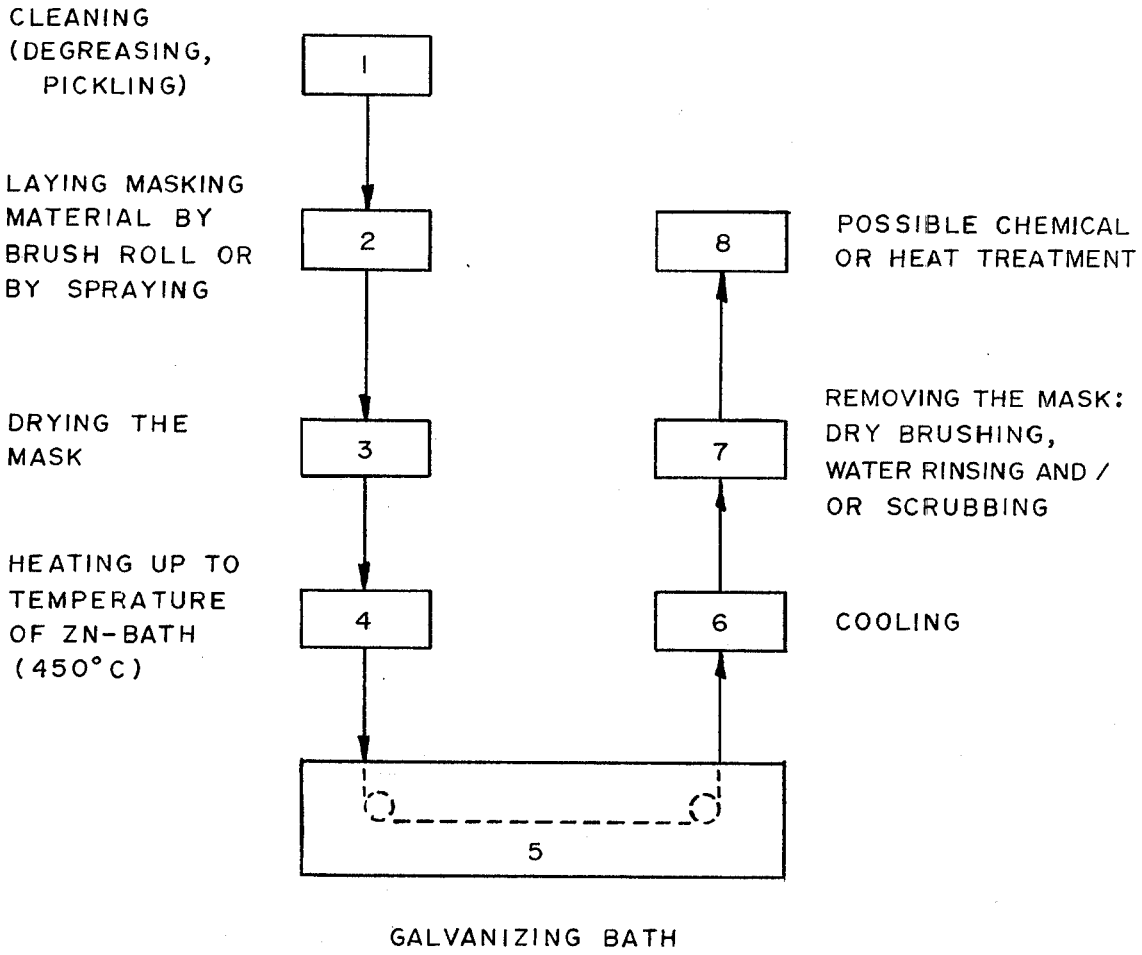
CLEANING (DEGREASING, PICKLING)
1
LAYING MASKING MATERIAL BY BRUSH ROLL OR BY SPRAYING
2
DRYING THE MASK
3
HEATING UP TO TEMPERATURE OF ZN-BATH (450°C)
4
5
GALVANIZING BATH
6
COOLING
7
REMOVING THE MASK: DRY BRUSHING, WATER RINSING AND / OR SCRUBBING
8
POSSIBLE CHEMICAL OR HEAT TREATMENT

METHOD FOR LOCALLY GALVANIZING A PIECE OF METAL

BACKGROUND OF THE INVENTION (1) Field of the Invention

The present invention relates to a method of locally coating a base metal with a molten metal coating, and more particularly to a method of galvanizing ferrous metal strip or sheet material on one side only. The present invention is also directed to the products obtained by said method.

(2) Description of the Prior Art

The purposes of one side coating of metal strips or sheets is well known and have been described in U.S. Pat. Nos. 3,121,019 and 3,149,987. Essentially one side coating of ferrous metal sheets is desirable to have corrosion resistant properties of zinc on one side of such sheet, while the opposite side has its original uncoated surface to permit i.a. paint adherence or spot welding.

The principal object of the present invention is to provide a process by means of which only a selected portion or portions of a metal piece can be galvanized. More specifically, this invention provides a method of galvanizing one side only of sheet metal. The process of the invention can be carried out either as a batch process on individual sheets, or it can be carried out as a continuous process on a strip. In either case, the steps performed on the material are the same.

In accordance with the present invention, the metal is first cleaned so that its surface is suitable for the reception of zinc. Those portions of the metal not to be galvanized are then coated with a masking material which is dried. Thereafter, the metal is heated and dipped in zinc, and, when the zinc coating has solidified, the masking material is removed. The surface that was previously covered with masking material is then clean and ready for whatever further treatment may be required.

Several masking materials have been proposed in the past. A suitable protective masking material must, however, to match the following requirements in order to provide an effective operation: It should be inexpensive, easy to apply and well adhering to the substrate during galvanization while being easy to remove after galvanization. The masking material must furthermore resist high temperature, i.e. a minimum temperature of about 450°-500° C., which is the temperature of the liquid zinc and preferably a temperature of 900° C. in order to protect the metal against oxidation during possible further heat treatment (e.g. annealing). The masking material should also not pollute the zinc bath and remain free of zinc in order to avoid an excessive drag-out of zinc from the galvanization. Finally the masking material and technique should allow an easy and inexpensive installation of the necessary equipment for existing galvanizing lines.

SUMMARY OF THE INVENTION

According to the present invention, there is provided an process wherein a ferrous metal article, preferably a strip or sheet, is coated on the surface to be protected by an aqueous suspension of cement, whereafter said article in sequence is dried and heated to a temperature above the melting point of the zinc, moved through a bath of molten zinc and finally undergoes a cleaning step to remove the cement.

BRIEF DESCRIPTION OF THE FIGURE

The present invention may be better understood by reference to the accompanying figure which is a flow chart depicting practice of the invention.

As used herein the term cement is to be understood to mean a finely ground mineral material generally comprising alumina, silica, lime, iron oxide and magnesia which have been burned in a kiln and which when mixed with water forms a plastic mass or paste which hardens by chemical combination, gelation and crystallization. Any type of conventional cement is suitable, Portland cement being particularly used in view of its availability.

The particle size of the cement to be used should be under 74μ and preferably between 0.25μ and 74μ.

In order to facilitate the coating of the masking material onto the metallic substrate, the masking material should be prepared as a rather fluid paste with water, wherein several other additives may be included. The addition of chlorhydric acid is highly desirable. Other additives such as binding agents, in order to promote the adherence of the masking material on the substrate, as well as viscosity modifier etc. are also within the scope of the present invention.

A mixture containing 140 ml of water, 140 ml of 10% chlorhydric acid and 200 gr of Portland cement is generally to be recommended because it will easily adhere to the substrate.

The coating of the masking material may be performed by means of any suitable equipment such as a brush, a roll or by spraying. This coating operation is preferably performed after the substrate material to be treated has been previously pickled preferably by chlorhydric acid and/or degreased.

The drying and heating step may be performed by any suitable means such as a heating oven operated at a suitable temperature.

Preferably the article to be treated is heated before introduction in the molten bath of zinc to a temperature approaching the temperature of the molten zinc bath.

After galvanization, the product may be cooled in an atmosphere of protecting gas, such as nitrogen.

The removal of the masking material may be performed by any suitable mechanical or physico-mechanical method such as air-blowing, dry scrubbing, water rinsing, with or without simultaneous scrubbing.

After removal of the masking material, the locally galvanized article may undergo a final rinsing step, e.g. by using cold water. In order to avoid any oxidation on the non-galvanized parts of the article, a solvant, preferably an solvant which is non-miscible with water may be added in the rinsing water.

After heating, the cement coating on the article will dry and adhere to the substrate allowing handling and transportation of the article and introduction into the molten zinc bath. The adherence is such that by scraping the cement by means of a suitable tool, localized surface areas may be rendered suitable for later galvanization.

The present invention is of interest for performing corrections or for making possible the galvanization of limited surfaces into a large field having received a masking layer.

The process is particularly suitable for the continuous coating of a strip or sheet of steel but is not limited thereto.

In order to illustrate further the invention, a specific embodiment of the invention will be described hereafter in reference to the accompanying flow-sheet of the method of the invention.

EXAMPLE

One side of a strip of steel which had been pickled, was coated with a preparation containing 140 ml water, 140 ml of 10% chlorhydric acid and 200 gr of Portland cement.

The coating process resulted in a surface coating consisting of 170 gr of dry material per square meter. The sheet was thereafter heated to 400° C. approximately, to dry the coating, and then immersed in a bath of molten zinc at a temperature of about 440°–460° C. The sheet was withdrawn from the bath after one min. and rinsed under tap water while brushing.

The resulting galvanized metal sheet had a brilliant surface on the side which is not galvanized, while the other side is covered uniformly by a layer of zinc showing the usual quality which is observed for both side galvanizing.

We claim:

1. A method for the controlled galvanization of a ferrous metal article comprising the steps of:

cleaning the article;

applying an aqueous suspension of a Portland cement to surface areas of the article which are not to be galvanized to form a coating on at least a portion of the article;

heating the coated article;

immersing the heated article in a bath of molten zinc; and removing the galvanized article from the molten zinc and mechanically removing the coating therefrom to expose ungalvanized surface areas on the article.

2. The method of claim 1 wherein the step of heating comprises:

heating the article to dry the coating; and further heating the article above the melting point of zinc.

3. The method of claim 1 wherein the step of applying an aqueous suspension comprises:

forming the aqueous solution by mixing Portland cement having an average particle size in the range of between 0.25$\mu$ and 74$\mu$ with water.

4. The method of claim 3 wherein the step of forming the aqueous solution further includes:

adding chlorhydric acid to the water.

5. The method of claim 1 wherein the step of applying an aqueous suspension comprises:

forming a mixture containing water, chlorhydric acid and Portland cement having particle sizes in the range of between 0.25$\mu$ and 74$\mu$.

6. The method of claim 5 wherein the step of heating comprises:

heating the article to dry the coating; and further heating the article above the melting point of zinc.

7. The method of claim 6 wherein the mixture is controlled to the proportions of 140 ml of water, 140 ml of 10% chlorhydric and 200 gr of Portland cement.

8. The method of claim 7 further comprising the step of:

rinsing the article with water subsequent to removal of the coating.

9. The method of claim 6 further comprising the step of:

rinsing the article with water subsequent to removal of the coating.

* * * * *